US006839952B2

(12) United States Patent
Hamilton

(10) Patent No.: US 6,839,952 B2
(45) Date of Patent: Jan. 11, 2005

(54) COMPOSITE PALLET

(76) Inventor: Frederick W. Hamilton, P.O. Box 198, Newton, MS (US) 39345

( * ) Notice: Subject to any disclaimer, the term of this patent is extended or adjusted under 35 U.S.C. 154(b) by 103 days.

(21) Appl. No.: 10/348,636

(22) Filed: Jan. 21, 2003

(65) Prior Publication Data

US 2004/0139593 A1 Jul. 22, 2004

(51) Int. Cl.[7] ..... B23P 11/00

(52) U.S. Cl. ..... 29/525.01; 29/772; 29/784; 108/56.1; 108/57.17; 108/57.21; 108/57.22; 108/153.1

(58) Field of Search ..... 29/525.01, 525.11, 29/772, 784; 108/51.11, 56.1, 57.17, 57.18, 57.19, 57.21, 57.22, 57.25, 57.32, 153.1, FOR 103

(56) References Cited

U.S. PATENT DOCUMENTS

| | | | | | |
|---|---|---|---|---|---|
| 2,287,740 | A | * | 6/1942 | Klouman | 248/176.2 |
| 3,602,157 | A | | 8/1971 | Cohen | 108/51 |
| 3,878,796 | A | | 4/1975 | Morrison | 108/56 |
| 4,359,948 | A | | 11/1982 | Judy et al. | 108/56.1 |
| 4,715,294 | A | * | 12/1987 | Depew | 108/57.17 |
| 4,929,899 | A | * | 5/1990 | Weixelman et al. | 324/253 |
| 5,440,998 | A | * | 8/1995 | Morgan et al. | 108/57.18 |
| 5,579,701 | A | * | 12/1996 | Fook Wah | 108/56.1 |
| 5,809,902 | A | * | 9/1998 | Zetterberg | 108/51.11 |
| 5,896,818 | A | * | 4/1999 | Phillips | 108/51.11 |
| 6,192,807 | B1 | * | 2/2001 | Mason | 108/51.11 |
| 6,234,086 | B1 | * | 5/2001 | Mason | 108/51.11 |
| 6,464,191 | B1 | | 10/2002 | Gerber | 248/346.01 |
| 2002/0056406 | A1 | * | 5/2002 | Dumouchel | 108/57.25 |

FOREIGN PATENT DOCUMENTS

| | | | | |
|---|---|---|---|---|
| EP | 0006366 | A1 * | 1/1980 | B65D/19/28 |

* cited by examiner

*Primary Examiner*—David P. Bryant
*Assistant Examiner*—Jermie E. Cozart
(74) *Attorney, Agent, or Firm*—Donald J. Ersler

(57) ABSTRACT

A composite pallet includes at least two channels and a plurality of stringers. Each channel includes a U-shaped cross-section with an inward facing leg extending from each outer edge of the U-shaped cross-section. Each stringer preferably includes a lengthwise body and at least two retention members. At least two channel retention slots are formed on a bottom of each stringer. Each retention slot is sized to receive an outer width of the channel. Each retention member is attached to a bottom of a stringer in a single channel retention slot. At least one fastener is inserted through the junction of a single stringer and a single channel. A second embodiment of the composite pallet includes at least two channels with outward facing legs and a plurality of stringers with projections that are sized to receive the at least two channels.

14 Claims, 5 Drawing Sheets

COMPOSITE PALLET

BACKGROUND OF THE INVENTION

1. Field of the Invention

The present invention relates generally to pallets for shipping goods and more specifically to a composite pallet, which may be repaired if damaged.

2. Discussion of the Prior Art

There are numerous pallets in the art, which are not fabricated from wood channels and stringers. U.S. Pat. No. 3,692,157 to Cohen discloses a pallet. The pallet is fabricated from a plurality of slat members attached to a plurality of channel members. U.S. Pat. No. 3,878,796 to Morrison discloses a plastic pallet assembly. The plastic pallet assembly includes a plurality of boards retained by a plurality of stringers. U.S. Pat. No. 4,359,948 to Judy et al. discloses a knock-down pallet and stringer attaching mechanism. The knock-down pallet includes a plurality of interconnecting stringers. U.S. Pat. No. 6,464,191 to Gerber discloses a skid for supporting loads. The skid for supporting loads includes a pair of longitudinal rails attached to a pair of transverse members.

Accordingly, there is a clearly felt need in the art for a composite pallet, which may be repaired, has a cost similar to that of a wood pallet and may be easily recycled.

SUMMARY OF THE INVENTION

The present invention provides a composite pallet, which may be repaired if damaged. The composite pallet includes at least two channels and a plurality of stringers. Each channel includes a U-shaped cross-section with an inward facing leg extending from each outer edge of the U-shaped cross-section. A pair of fork openings are preferably formed through the width of each channel to provide clearance for a pair of forks of a forklift. Each stringer preferably includes a lengthwise body and at least two retention members. At least two channel retention slots are formed on a bottom of each stringer. Each channel retention slot is preferably formed by extending a pair of tapered projections from a bottom of the stringer. The distance between the tapered projections are sized to receive an outer width of a single channel. Each retention member is attached to a bottom of a stringer between the pair of tapered projections. At assembly, at least one fastener is preferably inserted through the junction of a single stringer and a single channel to laterally retain the stringer relative to the channel. End stringers preferably include an impact surface to protect the end of each channel.

A second embodiment of the composite pallet includes at least two channels and a plurality of stringers. Each channel includes a U-shaped cross-section with an outward facing leg extending from each outer edge of the U-shaped cross-section. A pair of fork openings are preferably formed through the width of each channel to provide clearance for a pair of forks of a forklift. At least two channel projections are formed on a bottom of each stringer. Each channel projection is sized to receive an inside width of one of the two channels. A leg projection is spaced from each side of the channel projection with a leg slot. The leg slot is sized to receive a width of the outward facing leg. At least two fasteners are preferably used to attach a single channel and stringer at each junction thereof. End stringers preferably include an impact surface to protect the end of each channel.

Accordingly, it is an object of the present invention to provide a composite pallet, which may be repaired when damaged.

It is a further object of the present invention to provide a composite pallet, which may be easily recycled.

It is yet a further object of the present invention to provide a composite pallet, which protects the channels thereof from damage with an impact surface.

Finally, it is another object of the present invention to provide a composite pallet with a cost similar to that of a wood pallet.

These and additional objects, advantages, features and benefits of the present invention will become apparent from the following specification.

DETAILED DESCRIPTION OF THE PREFERRED EMBODIMENTS

Figure 1:
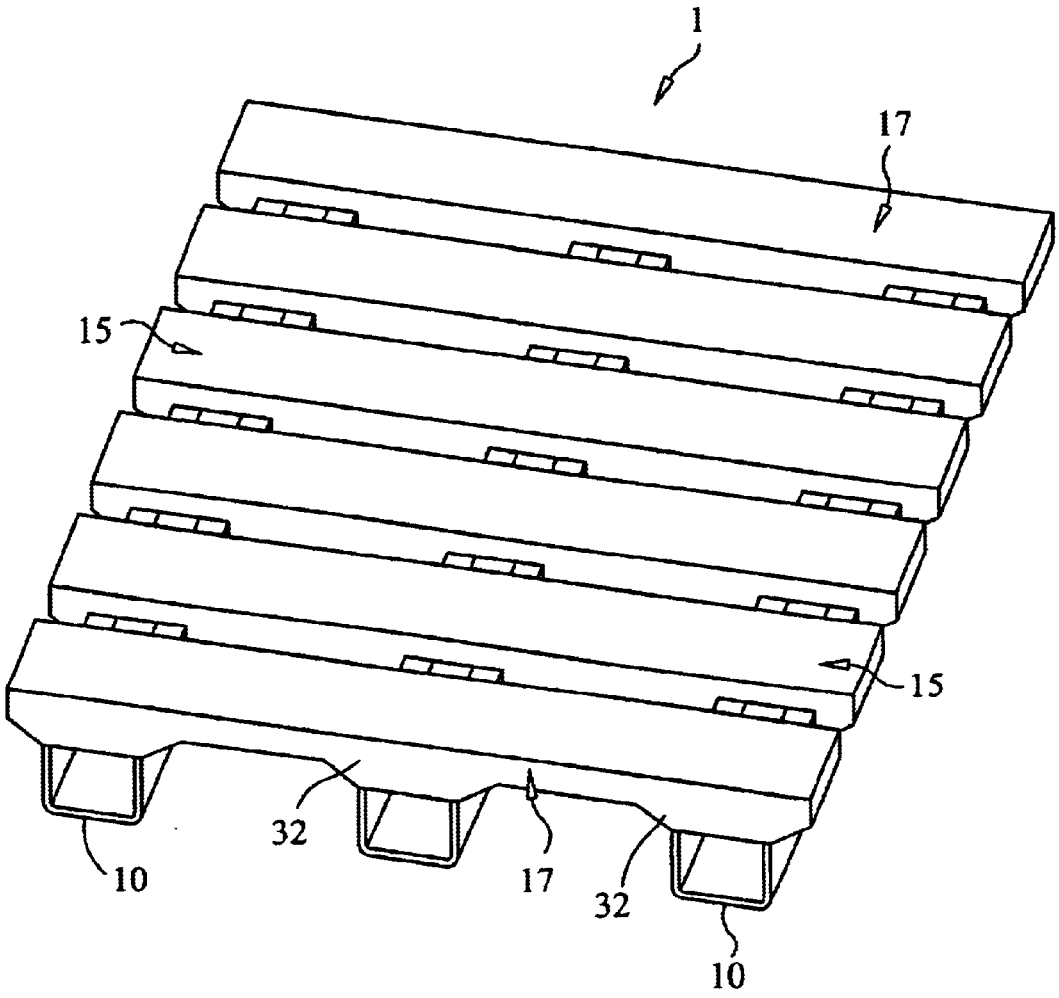
FIG. 1 is a perspective view of a composite pallet in accordance with the present invention.
Figure 2:
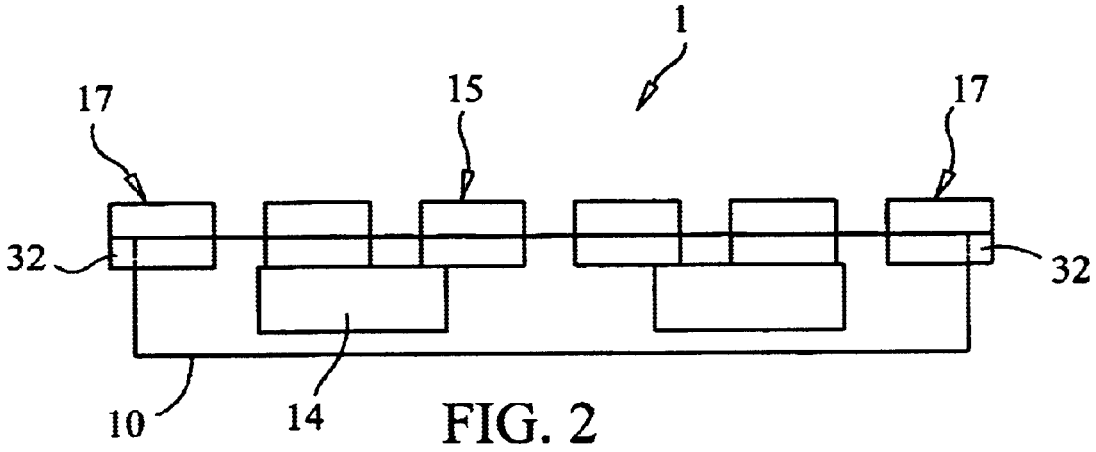
FIG. 2 is a side view of a composite pallet in accordance with the present invention.
Figure 3:
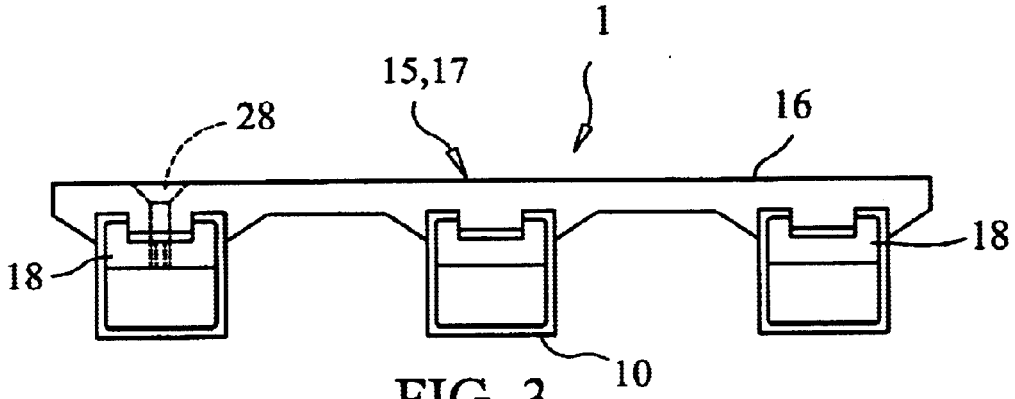
FIG. 3 is an end view of a composite pallet with an end stringer removed in accordance with the present invention.
Figure 4:
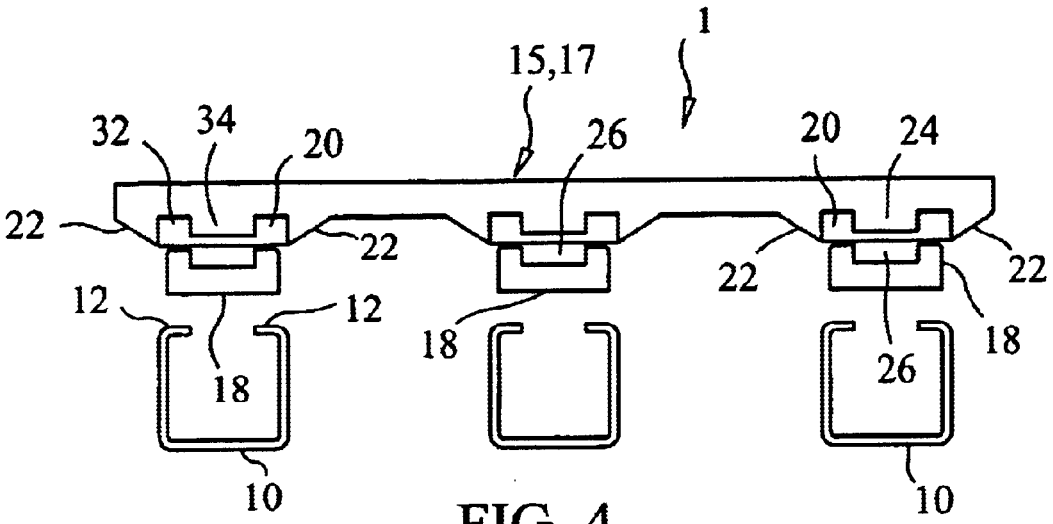
FIG. 4 is an end view of a stringer positioned above three channels of a composite pallet and with an end stringer removed in accordance with the present invention.

With reference now to the drawings, and particularly to FIG. 1, there is shown a perspective view of a composite pallet 1. With reference to FIGS. 2–4, the composite pallet 1 includes a at least two channels 10 and a plurality of stringers. Each channel 10 includes a U-shaped cross-section with an inward facing leg 12 extending from each outer edge of the U-shaped cross-section. A pair of fork openings 14 are preferably formed through the width of each channel 10 to provide clearance for a pair of forks of a forklift. The at least two channels 10 are preferably fabricated from a noncorrosive or corrosive resistant material such as aluminum or galvanized steel, but other materials may also be used. The plurality of stringers preferably include at least one cross stringer 15 and two end stringers 17. Each stringer 15, 17 preferably includes a lengthwise body 16 and at least two retention members 18. Each end stringer 17 also includes an impact surface 32 to protect the end of each channel 10. The plurality of stringers 15, 17 are preferably fabricated from a plastic material, but other materials also be used.

Figure 5:
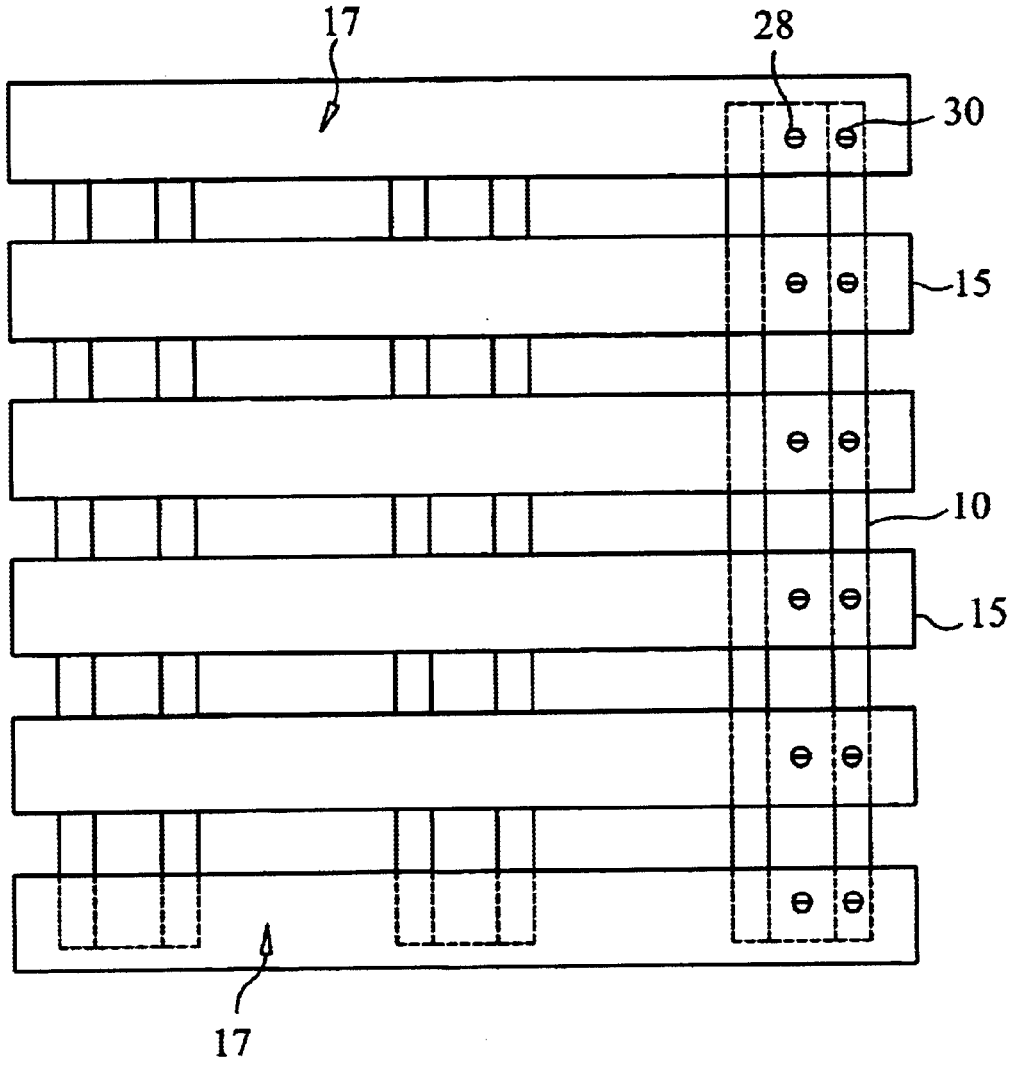
FIG. 5 is a top view of a composite pallet in accordance with the present invention.
Figure 6:
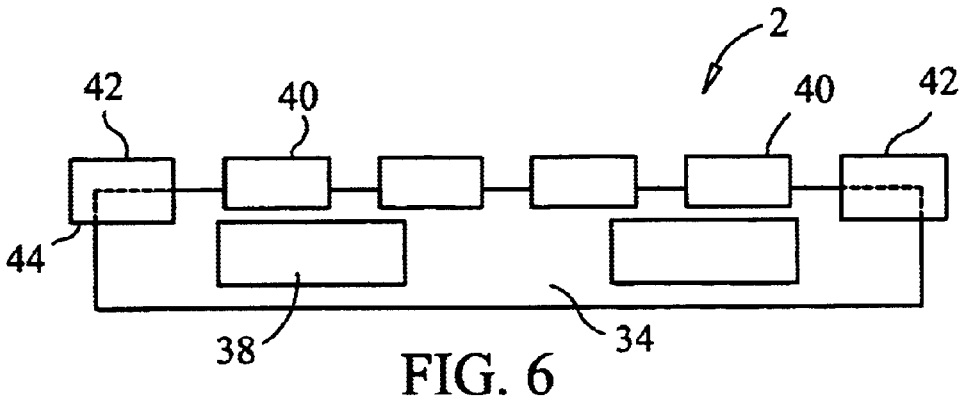
FIG. 6 is a side view of a second embodiment of a composite pallet in accordance with the present invention.
Figure 7:
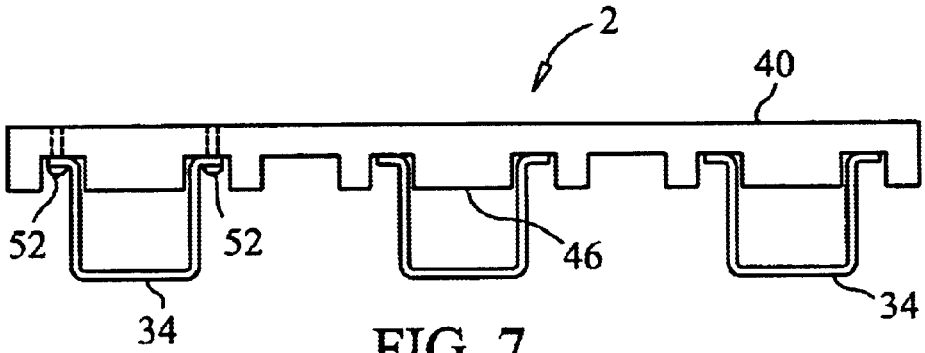
FIG. 7 is an end view of a second embodiment of a composite pallet with both end stringers removed in accordance with the present invention.
Figure 8:
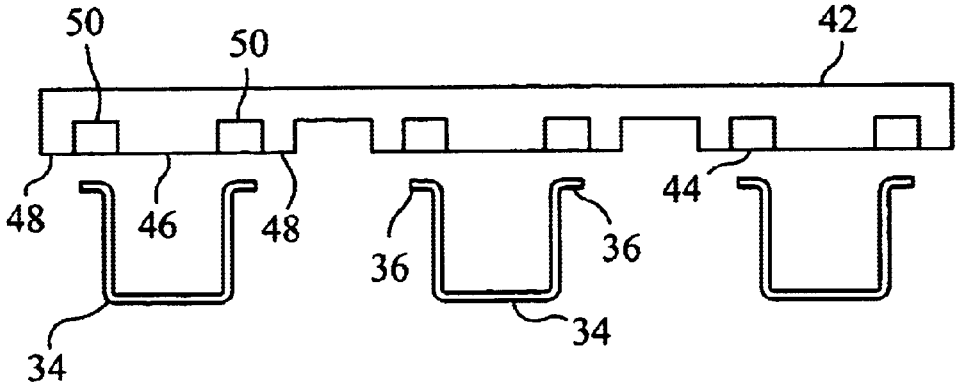
FIG. 8 is an end view of a stringer positioned above three channels of a second embodiment of a composite pallet and with an end stringer removed in accordance with the present invention.
Figure 9:
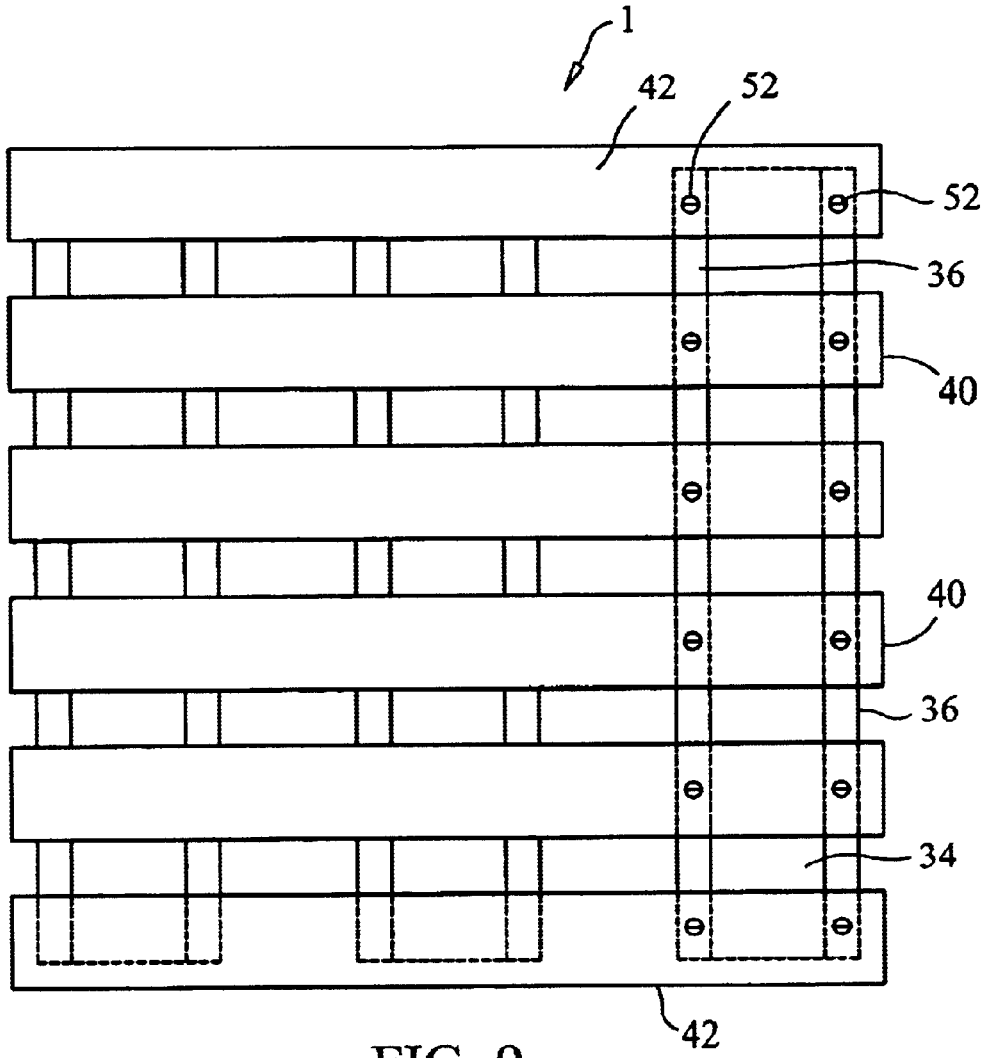
FIG. 9 is a top view of a second embodiment of a composite pallet in accordance with the present invention.
Figure 10:
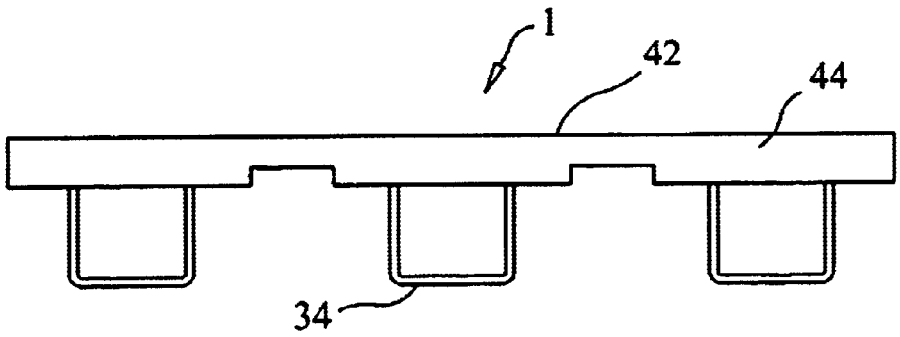
FIG. 10 is an end view of a second embodiment of a composite pallet in accordance with the present invention.

At least two channel retention slots 20 are formed on a bottom of each stringer 15, 17. Each channel retention slot 20 is preferably formed by extending a pair of tapered projections 22 from a bottom of the plurality of stringers 15, 17. The distance between the tapered projections 22 are sized to receive an outer width of the channel 10. A center projection 24 is preferably formed in a center of each retention slot 20. A width of the center projection 24 is sized to receive a width between the inward facing legs 12. Each retention member 18 includes a center projection slot 26, which is sized to receive the center projection 24. Each retention member 18 is attached to a bottom of the stringer 15, 17 with a removable fastener 28 or the like. With reference to FIG. 5, at least one removable fastener 30 is inserted through the junction of a single stringer 15, 17 and a single channel 10 to laterally retain the stringer 15, 17 relative to the channel 10.

A second embodiment of the composite pallet 2 includes at least two channels 34 and a plurality of stringers. Each channel 34 includes a U-shaped cross-section with an outward facing leg 36 extending from each outer edge of the U-shaped cross-section. A pair of fork openings 38 are preferably formed through the width of each channel 34 to provide clearance for a pair of forks of a forklift. The at least two channels 34 are preferably fabricated from a noncorrosive or corrosive resistant material such as aluminum or galvanized steel, but other materials may also be used. The plurality of stringers preferably include at least one cross stringer 40 and two end stringers 42. Each end stringer 42 also includes an impact surface 44 to protect the end of each channel 34. The plurality of stringers 40, 42 are preferably fabricated from a plastic material, but other materials also be used.

At least two channel projections 46 are formed on a bottom of each stringer 40, 42. Each channel projection 46 is sized to receive an inside width of a single channel 34. A leg projection 48 is spaced from each side of the channel projection 46 with a leg slot 50. The leg slot 50 is sized to receive a width of the outward facing leg 36. At least two removable fasteners 52 are preferably used to attach a single channel 34 and stringer 40, 42 at each junction thereof.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of forming a composite pallet comprising the steps of:

providing at least two channels;

providing two end stringers and at least one cross stringer, forming at least two slots in each one of said two end stringers and in said at least one cross stringer to receive said at least two channels;

attaching removably said plurality of stringers to said at least two channels with at least one removable fastener at each junction thereof; and forming an impact surface on each end of each one of said two end stringers to protect each end of said at least two channels.

2. The method of forming a composite pallet of claim 1, further comprising the step of:

providing each one of said at least two channels with a U-shaped cross-section having an inward facing leg extending from each outer edge thereof.

3. The method of forming a composite pallet of claim 1, further comprising the step of:

providing each one of said at least two channels with a U-shaped cross-section having an outward facing leg extending from each outer edge thereof.

4. The method of forming a composite pallet of claim 1, further comprising the step of:

forming a pair of fork openings through a width of each one of said at least two channels.

5. The method of forming a composite pallet of claim 1, further comprising the step of:

providing at least two retention members for retaining said at least two channels against said at least one cross stringer and each one of said two end stringers.

6. The method of forming a composite pallet of claim 1, further comprising the step of:

forming a tapered projection on a bottom of said at least one cross stringer and each one of said two end stringers adjacent at least one side of each one of said at least two channels.

7. A method of forming a composite pallet comprising the steps of:

providing at least two channels, each one of said at least two channels having a U-shaped cross-section with an inward facing leg extending from each outer edge thereof;

providing two end stringers and at least one cross stringer, forming at least two slots in each one of said two end stringers and in said at least one cross stringer to receive said at least two channels;

attaching removably said plurality of stringers to said at least two channels;

forming an impact surface on each one of said two end stringers to protect each end of said at least two channels.

8. The method of forming a composite pallet of claim 7, further comprising the step of:

forming a pair of fork openings through a width of each one of said at least two channels.

9. The method of forming a composite pallet of claim 8, further comprising the step of:

providing at least two retention members for retaining said at least two channels against said at least one cross stringer and each one of said two end stringers.

10. The method of forming a composite pallet of claim 7, further comprising the step of:

forming a tapered projection on a bottom of said at least one cross stringer and each one of said two end stringers adjacent at least one side of each said channel.

11. The method of forming a composite pallet of claim 7, further comprising the step of:

attaching removably said plurality of stringers to said at least two channels with a removable fastener at each junction thereof.

12. A method of forming a composite pallet comprising the steps of:

providing at least two channels, each one of said at least two channels having a U-shaped cross-section with an outward facing leg extending from each outer edge thereof;

providing two end stringers and at least one cross stringer, forming at least two pairs of slots in each one of said two end stringers and in said at least one cross stringer to receive said at least two channels;

attaching removably said plurality of stringers to said at least two channels;

forming an impact surface on each one of said two end stringers to protect each end of said at least two channels.

13. The method of forming a composite pallet of claim 12, further comprising the step of:

forming a pair of fork openings through a width of each one of said at least two channels.

14. The method of forming a composite pallet of claim 12, further comprising the step of:

attaching removably said plurality of stringers to said at least two channels with a removable fastener at each junction thereof.

* * * * *